United States Patent [19]

Folland et al.

[11] 4,117,550

[45] Sep. 26, 1978

[54] EMULSIFYING SYSTEM

[75] Inventors: Roy E. Folland, Clarenceville; Richard C. Millar, Otterburn Park, both of Canada

[73] Assignee: Folland Enertec Ltd., Quebec, Canada

[21] Appl. No.: 768,171

[22] Filed: Feb. 14, 1977

[51] Int. Cl.[2] ..... B01F 5/10; B01F 15/02

[52] U.S. Cl. ..... 366/136; 137/1; 137/563; 366/145; 366/176; 366/336

[58] Field of Search ..... 259/4 R, 7, 8, 5, 6; 137/1, 563, 13; 366/131, 136, 137, 154, 159, 176

[56] References Cited

U.S. PATENT DOCUMENTS

| | | | |
|---|---|---|---|
| 2,692,764 | 10/1954 | Hanson | 239/428 |
| 2,900,176 | 8/1959 | Krogel | 259/4 R |
| 2,992,084 | 7/1961 | Schropp | 259/4 R |
| 3,499,632 | 3/1970 | Piros | 259/4 R |
| 3,684,250 | 8/1972 | Roeser | 259/8 |
| 3,749,318 | 7/1973 | Cottell | 239/102 |
| 3,902,868 | 9/1975 | Zoch | 239/102 |
| 3,986,669 | 10/1976 | Martner | 239/102 |

*Primary Examiner*—Robert W. Jenkins

[57] ABSTRACT

An emulsifying system for mixing accurate ratios of two or more liquids to form an emulsion. The liquids are preferably, but not exclusively, water and oil. A supply circuit delivers accurate mixtures of the two or more liquids. An emulsifier emulsifies the mixture to form an emulsion. A container stores a quantity of the emulsion that may vary between predetermined limits and an output circuit is provided to draw the emulsion from the storage container. The emulsion storage container permits the supply of the mixture and the emulsion to the storage container at a rate independent of the rate at which the emulsion is drawn from the output circuit.

7 Claims, 2 Drawing Figures

EMULSIFYING SYSTEM

BACKGROUND OF INVENTION (a) Field of the Invention

The present invention relates to an improved emulsifying system and method for mixing accurate ratios of two or more liquids to form an emulsion. Preferably, but not exclusively, the liquids are water and oil which are pressure regulated and the supply is isolated from a vented storage container which stores the emulsion to feed emulsion burning apparatus.

(b) Description of Prior Art

There exists a need to provide efficient means of mixing water and oil together to form an emulsion to feed burning apparatus whereby to reduce pollutants which are released in the atmosphere and which also reduce the efficiency of burning apparatus and associated devices. Further, by providing a water/oil emulsion, less oil is consumed by the burning system. Various chemicals and apparatus have heretofore been provided in an attempt to achieve such objectives. However, such known methods and apparatus have not proved to be entirely efficient and economical.

Surfactants are sometimes used to break down the surface tension of one of the fluids to be mixed together, whereby to enable the mixing to take place. Surfactants are usually expensive and require additional savings in the system construction whereby to justify the cost thereof. Also, it has been found that surfactants promote boiler and flue corrosion. The very fact that the surface tension is reduced, eliminates or diminishes the microexplosions which take place with an emulsion produced without surfactants. These microexplosions are important to the improved performance of burning emulsion.

It is also known to use sonic whistles or similar type devices together with high pressure pumps to produce a desired emulsion. However, known systems which use such devices do not provide means to reduce capacity in order to correspond to varying firing rates of burners, without reducing feed pressures. The reduction of feed pressures seriously reduces the effectiveness of this type of equipment thereby providing a drawback.

Another type of apparatus known is the piston type homogenizer which is used to produce emulsions from water and oil. These homogenizers, however, require very large amounts of horsepower, require frequent maintenance, and are expensive.

Another type of prior art device known is the ultrasonic reactor which is used to produce a water/oil emulsion. This equipment is, however, very expensive, and uneconomical. Also, such reactors are known to fail due to overpressure, startup with cold oil, etc. This type of system is susceptible to damage from external pressure sources.

Controlling water to oil ratio is very difficult because there is a reliance on standard control items which in themselves are not accurate while trying to proportion through the range of firing rates of a burner system. Known methods and devices, such as those described above, are also very costly.

Recirculating or circulating emulsion through a burner system has been very difficult, if not impossible to achieve, because of the problem of contaminating the straight oil with emulsion.

SUMMARY OF INVENTION

It is, therefore, a feature of this invention to substantially overcome all of the above-mentioned disadvantages of the prior art and to provide an emulsifying system for mixing two or more liquids to form a stable emulsion.

A further feature of the present invention is to substantially eliminate the use of surfactants or any other chemical which is only used to produce such an emulsion.

A still further feature of the present invention is to provide a water/oil emulsion for burning and very accurately control the pressure of incoming fuel oil and water, always at one constant flow rate, to permit the control of very accurate proportions of the water and oil at any desired percentage, and at very reasonable cost.

A still further feature of the present invention is to store the emulsion in a container which is vented to atmosphere and totally isolate the output circuit from the high pressure supplies and to recirculate the emulsion to maintain it in a stable state and further to recirculate the emulsion through the burner system, in the same manner as the oil system is circulated without contaminating the straight oil with emulsion.

Another feature of the present invention is to produce an emulsion for feeding mixing devices such as ultrasonic reactors, or cells whereby to considerably increase the flow capacity therethrough to render such apparatus more economical.

According to the above features, from a broad aspect, the present invention provides an emulsifying system for mixing accurate ratios of two or more liquids to form an emulsion. The system comprises means for supplying an accurate mixture of the two or more liquids. Emulsifying means is provided to emulsify the mixture into an emulsion. Emulsion storage means is also provided for storing a quantity of the emulsion that may vary between predetermined limits. An output circuit draws the emulsion from the emulsion storage means. Emulsion storage means permits the supply of the mixture and the emulsion at a rate independent of the rate at which the emulsion is drawn from the output circuit.

According to a still further broad aspect of the present invention, there is provided a method of mixing accurate ratios of two or more liquids and forming a stable emulsion therefrom. The method comprises the steps of mixing the two or more liquids in an accurate proportion to form a mixture. An emulsion is then produced from the mixture. Emulsion is then stored in a storage means to permit the supply of the mixture and the emulsion to the storage means at a rate independent of the rate at which the emulsion is drawn from the storage means.

BRIEF DESCRIPTION OF DRAWINGS

A preferred embodiment of the present invention will now be described with reference to the accompanying drawings, in which.

DESCRIPTION OF PREFERRED EMBODIMENTS

Figure 1:
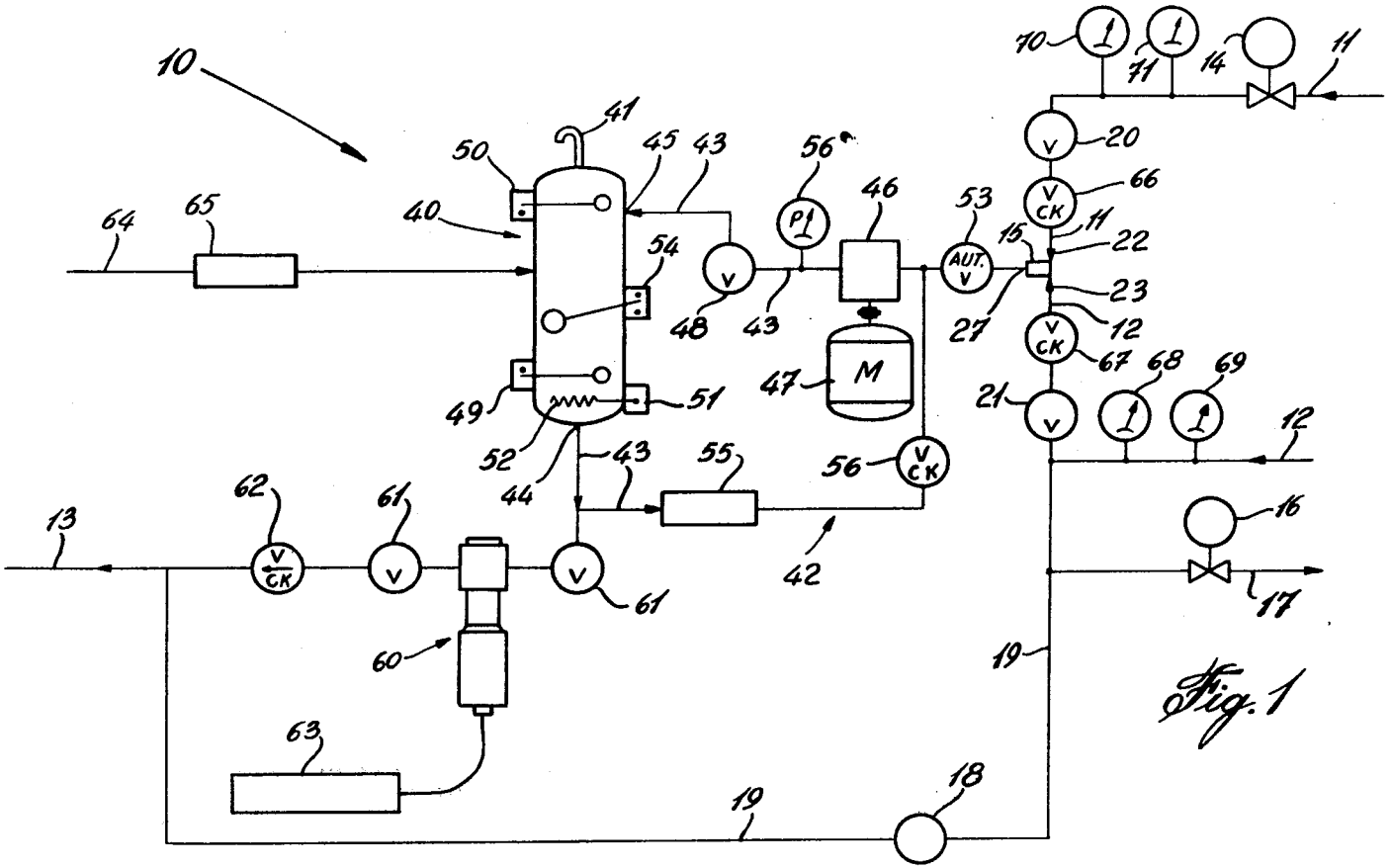
FIG. 1 is a schematic diagram of the emulsifying system.

Referring now to the drawings, there is shown generally at 10, the emulsifying system of the present invention for mixing accurate ratios of water and oil taken from a water supply line 11 and an oil supply line 12, to form a water/oil emulsion for feeding burning apparatus (not shown) and fed at the emulsion output supply line 13. A pressure regulator 14, of simple and inexpensive design and of a type known in the art, is connected in the water supply line 11 to feed water under pressure to an injector device 15. Similarly, a back pressure regulator 16 is provided in the return line 17 which connects to the oil line 12 to also feed oil under pressure to the injector 15. This pressure regulator is also of the type well known in the art. The purpose of using a back pressure regulator is to maintain a constant oil pressure in the oil line 12 while at the same time permitting recirculation of oil. When the system 10 is in use, the bypass valve 18 automatically shuts off thereby automatically disconnecting the bypass line 19 from the emulsion output supply line 13.

A flow restriction means, herein a ratio adjustment valve 20, is connected in the supply line 11 downstream of the pressure regulator 14. A similar flow restriction means or ratio adjustment valve 21, is connected in the oil supply line 12 also downstream of the pressure regulator. These valves 20 and 21 are adjustable needle valves of the type well known in the art, and adjust the flow rates through the supply lines 11 and 12, respectively, to permit the proper ratio of water and oil to be fed to the inputs 22 and 23, respectively, of the injector 15. This ratio is normally of the order of up to one part of water to four parts of oil.

Figure 2:
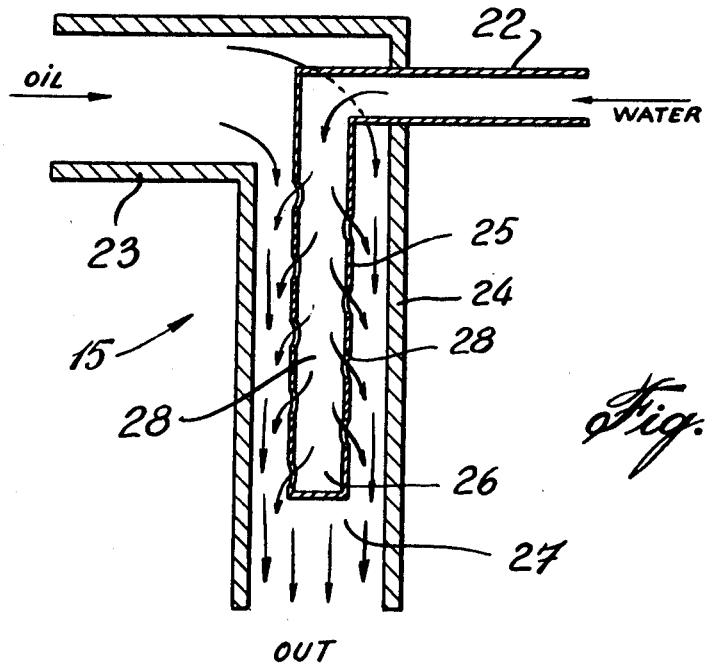
FIG. 2 is a sectional view of an example of the construction of an injector device.

Referring now, more specifically, to FIG. 2, there is shown an example of how the injector 15 may be constructed. As hereinshown, the injector 15 consists of a simple T-shaped mixing device consisting of an outer tubular portion 24 and an inner tubular portion 25 having an outlet end portion 26 positioned concentrically within the outlet portion 27 of the outer tubular portion 24. The outlet end portion 26 is perforated as shown at 28 to permit water within the inner tubular portion 25 to be released in the outlet portion of the outer tubular portion 24 to mix with oil flowing within the outer tubular portion. This permits the water to be released in close contact with the oil whereby the water and oil particles will mix. As hereinabove mentioned, this is only an example of the construction of the injector and many other types of injector devices can be provided.

The water/oil emulsion or mixture at the outlet portion 27 of the injector 15 is fed to emulsifying means being a pressure pump 46 feeding a pressure mixer 48. The emulsion at the output of the mixer 48 is fed to a container 40. This container 40 constitutes a storage means for a quantity of the water/oil emulsion fed to it from the injector 15. The pressure in the container 40 is controlled, for example, by means of a vent 41 herein schematically illustrated. The container 40 is further provided with a recirculating circuit 42 which consists of an emulsion recirculating conduit 43 connected in a loop from an outlet 44, taken from the bottom of the container 40, to an inlet of the pressure pump 46. The pressure pump 46 is driven by a pump motor 47. The pressure mixer 48 takes the full pressure drop of the pressure pump 46 whereby to generate the emulsion. The outlet from the pressure mixer 48 is fed to the inlet 45 of the container 40.

The container 40 is provided with a volume control means which is constituted by a level float switch 54. Further, a temperature sensing device 51 may be provided to sense the temperature of the emulsion in the container to make sure it does not fall below a certain predetermined temperature. A heater element 52 may also be connected to the temperature sensing device to heat the emulsion when it falls below the predetermined temperature. The heater element 52 is controlled by the temperature sensing device 51.

When the level of the emulsion within the container 40 falls below a predetermined low level or exceeds a predetermined high level, a signal is given to a shut-off valve 53 located in the flow line connected to the output portion 27 of the injector 15. This signal will either cause the shut-off valve to open or close. Thus, the valve 53 is either in a fully open or a fully closed position. The level switch 54 may be connected directly to the shut-off valve 53. High and low level float switches 49 and 50 protect against excessive volume changes.

The shut-off valve 53 can also be of a slow opening or slow closing type, i.e., 4 or 5 seconds, in order to give the regulators time to lock up or seat themselves, depending on the type of regulators utilized. In the event that the regulating system were to consist of receivers or pans, then this valve may be of the fast opening fast closing solenoid type. The pressure pump 46 may also consist of any type of positive displacement pump such as a gear pump, triplex piston pump, which will give sufficient pressure for it to cause the desired effect when processing the fluids through the pressure mixer 48.

In the event that the recirculation of the emulsion causes the temperature to increase beyond the desired predetermined temperature, then coolers 55 may be provided in the recirculating conduit 43 to prevent the emulsion temperature from exceeding the predetermined desired temperature. Check valve 56 is provided in the conduit 43 to permit unidirectional flow of the emulsion. Also, the pressure in the line 43 may be monitored by the provision of a pressure gauge 56' downstream of the pressure pump 46.

It can be noted that with the above system, there is provided a storage of an emulsion which is maintained in a desired stable state and which is isolated from the pressure supplies. Such emulsion may be fed directly to burner apparatus (not shown) without subjecting such burner apparatus to pressures within the emulsifying system. In one application of the system as shown in FIG. 1, the outlet 44 of the container 40 may be connected to a mixer device 60 whereby the emulsion particles are further broken down to provide a finer mix before delivery to the burner device (not shown). As herein illustrated, for purpose of example only, the mixer device 60 is a high frequency mixer device capable of shattering water particles to obtain a finer emulsion. As previously described, an ultrasonic reactor cell may herein be provided and emulsion is fed into a cavity (not shown) incorporating an ultrasonic vibrator (not shown) to cause a breakdown of the emulsion particles. Shutoff valves 61 are provided on each side of the mixer device 60 to permit replacement of this mixer device by other suitable devices or to interconnect the valves 61 directly when such further mixer device 60 is not required. A check valve 62 insures unidirectional flow to the emulsion output supply line 13. As also shown in FIG. 1, a power supply 63 feeds the high frequency mixing device 60.

As further shown in FIG. 1, a bypass return line 64 from the burner device (not shown), is connected to the container 40. Coolers 65 may also be provided in the bypass return line 64 to regulate the temperature of the emulsion therein. Also, unidirectional valves 66 and 67 are provided, respectively, in the supply lines 11 and 12 to permit unidirectional flow. Oil pressure switch 68 and oil temperature limit switch 69 monitor the temperature and pressure of the oil within the oil supply line 12. Similarly, low pressure water limit switch 70 and percent water gauge 71 monitor the water supply line 11.

The pressure mixer 48 may have various type constructions. With the use of bunker "C" fuel oil, there is always the chance of dirt coming through the system and plugging orifices and consequently it may be advisable to use an orifice arrangement together with a pressure unloading valve which will discharge back to the inlet of the pressure pump 46 or possibly to the container 40 in the event that the orifice was to plug. On the other hand, a common ball-type relief valve, such as the type identified by the registered Trade Mark "NU-PRO" may be used. In the event, of course, of any accumulation of dirt, then the ball in the valve would simply raise to clear itself. It may also be possible to use a simple chamber with various shape orifices or with an annular orifice, again using a pressure unloader or relief valve to prevent plugging. A still further alternative would be to use a sonic whistle of a type known in the art. Additionally, the efficiency of such whistle or any other device could be improved by modifying the discharge end to amplify the pressure fluctuations which theoretically should increase the performance.

The size of the container 40 may vary depending on the requirement of the application of the system. Various modifications of the system are seen without departing from the broad scope of the invention as defined by the appended claims.

The method of operation of this system can be summarized as follows. The water and oil supply lines are each provided with a pressure regulator whereby to supply water and oil to an injector device 15. The supply of the water and oil is regulated by ratio adjusting valves 20 and 21 respectively. The mix of water and oil at the outlet of the injector 15 is fed to a container 40 via a shut-off valve 53, and when the level of the emulsion 40 reaches a predetermined high level, the shut-off valve 53 is shut off, therefor isolating the pressure regulator supply lines from the container 40. The emulsion in the container 40 is recirculated through a recirculating circuit 42 and the emulsion is maintained in a stable state by a pressure mixer 48 which is fed by pressure pump 46 located in the emulsion recirculating circuit 42. The outlet of the container 40 is connected to burner apparatus (not shown) or to a further mixer device 60. As the emulsion is consumed, the level of the emulsion in the container 40 drops and when it reaches a predetermined low level, where it is necessary to replenish the container 40, the shut-off valve 53 is opened supplying more emulsion to the container 40. The size of the container 40 is selected to appropriately supply the burner device (not shown). It can be seen that whilst the container 40 is being supplied, the pressure from the water and oil supply lines will be vented through the container 40 as the check valve 56 will prevent any direct connection of these supply lines to the burner device (not shown) or the mixer device 60.

The emulsifying means, defined herein, could, for example, be an ultrasonic emulsifying device of a type known in the art similar to device 60. Also, as abovementioned, the proportioning and mixing of the liquids can be effected in a variety of ways. It is also foreseen that this system could be utilized as an economical means of providing emulsions for uses other than for combustion, for example, in applications to the food and cosmetic industry.

It is further pointed out, that due to the improved combustion process resulting from the burning of the emulsion produced by the invention, particulate emissions is drastically reduced thereby making this invention a most important pollution control apparatus. Furthermore, there is achieved a great improvement of energy conservation.

We claim:

1. An emulsifying system for mixing accurate ratios of two or more liquids to form an emulsion, said system comprising means for supplying an accurate mixture of said two or more liquids, an emulsifying device to emulsify said mixture into an emulsion, emulsion storage means for storing a quantity of said emulsion that may vary between predetermined limits, an output circuit to draw said emulsion from said emulsion storage means, a recirculating circuit connected at said output circuit and having a recirculating pump to recirculate said emulsion to said emulsifying device where said emulsion is regenerated and returned to said storage means whereby said emulsion in said storage means is maintained in a usable state, said emulsion storage means permitting the supply of said mixture to it at a rate independent of the rate at which said emulsion is drawn from said output.

2. A system as claimed in claim 1 wherein said emulsion is a water/oil emulsion for use as a combustible fuel.

3. A system as claimed in claim 3 wherein said means for supplying an accurate mixture comprises injection means fed by a regulated water and oil supply to provide said accurate mixture of said water and oil, said injection means is an injector device having a water flow inlet and an oil flow inlet connected respectively to said water and oil regulated supplies, conduit means to release water and oil flows from said inlets to mix in said injector device, said regulated supplies being pressure regulated supplies, said pressure regulated supplies each have a pressure regulating device and a flow restriction means located downstream of said pressure regulating device, said flow restriction means controlling the flow rate of said water and oil supplies for delivery to said water flow inlet and oil flow inlet, respectively, of said injection device.

4. A system as claimed in claim 3, wherein said water/oil emulsion is drawn into said recirculating circuit by said recirculating pump, said emulsifying device being connected between said recirculating pump and said storage means, said storage means being provided with volume control means to control the flow of said water/oil emulsion from said injection means to said storage means, said storage means further comprising temperature control means to maintain said water/oil emulsion at a desired temperature, input means connected to said storage means to feed back water/oil emulsion from a burner, and wherein said output circuit is connected to said burner whereby said burner draws said water/oil emulsion from said storage means when in operation.

5. A system as claimed in claim 1, wherein valve means is provided downstream of said means for supplying an accurate mixture to isolate said storage means from pressure from said means for supplying said accurate mixture.

6. A system as claimed in claim 1, wherein said storage means is vented to atmosphere.

7. A method of mixing accurate ratios of two or more liquids and forming a stable emulsion therefrom comprising the steps of:

(i) mixing said two or more liquids in an accurate proportion to form a mixture, (ii) producing an emulsion from said mixture, (iii) supplying said emulsion to a storage means to maintain the level emulsion in said storage means between predetermined limits, (iv) withdrawing said emulsion from said storage means at a rate independent of the rate at which said emulsion is supplied to said storage means, and (v) feeding said emulsion from said storage means to an emulsifying device where said emulsion is regenerated and fed back to said storage means.

* * * * *

UNITED STATES PATENT AND TRADEMARK OFFICE

CERTIFICATE OF CORRECTION

PATENT NO. : 4,117,550

DATED : September 26, 1978

INVENTOR(S) : Folland et al

It is certified that error appears in the above–identified patent and that said Letters Patent are hereby corrected as shown below:

Claim 3, line 1, (column 6, line 41), change "3" to --2--

Signed and Sealed this

*Third* Day of *April 1979*

[SEAL]

*Attest:*

RUTH C. MASON
*Attesting Officer*

DONALD W. BANNER
*Commissioner of Patents and Trademarks*